US011423829B2

(12) United States Patent
Choi et al.

(10) Patent No.: US 11,423,829 B2
(45) Date of Patent: Aug. 23, 2022

(54) CLOCK GENERATING CIRCUIT FOR LED DRIVING DEVICE AND METHOD FOR DRIVING

(71) Applicant: SILICON WORKS CO., LTD., Daejeon (KR)

(72) Inventors: Jin Ho Choi, Daejeon (KR); Jang Su Kim, Daejeon (KR); Tae Geun Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/185,632

(22) Filed: Feb. 25, 2021

(65) Prior Publication Data

US 2021/0272512 A1 Sep. 2, 2021

(30) Foreign Application Priority Data

Mar. 2, 2020 (KR) ..... 10-2020-0026092
Feb. 8, 2021 (KR) ..... 10-2021-0017540

(51) Int. Cl.
*G09G 3/32* (2016.01)

(52) U.S. Cl.
CPC ..... *G09G 3/32* (2013.01); *G09G 2310/08* (2013.01); *G09G 2370/08* (2013.01)

(58) Field of Classification Search
CPC ..... G09G 2370/08; G09G 3/2014; G09G 2330/021
See application file for complete search history.

(56) References Cited

U.S. PATENT DOCUMENTS

| | | | | |
|---|---|---|---|---|
| 9,231,751 | B1 | 1/2016 | Lin | |
| 9,280,928 | B2 | 3/2016 | Li et al. | |
| 10,319,278 | B1 * | 6/2019 | Nho | G09G 3/2018 |
| 2006/0284663 | A1 * | 12/2006 | Lu | H03H 11/26 327/268 |
| 2007/0018932 | A1 * | 1/2007 | Takaki | G09G 3/3688 345/98 |
| 2008/0309607 | A1 * | 12/2008 | Arai | G09G 3/3688 345/99 |
| 2009/0167750 | A1 * | 7/2009 | Hong | G09G 3/2096 345/213 |
| 2011/0043693 | A1 * | 2/2011 | Nakahira | H03L 7/0812 348/512 |
| 2012/0242721 | A1 * | 9/2012 | Saito | G09G 3/294 345/690 |

* cited by examiner

*Primary Examiner* — William Boddie
*Assistant Examiner* — Bipin Gyawali
(74) *Attorney, Agent, or Firm* — Fenwick & West LLP

(57) ABSTRACT

The present disclosure provides a technique for reducing power consumption of circuits generating clocks for driving LEDs.

15 Claims, 11 Drawing Sheets

700

CLOCK GENERATING CIRCUIT FOR LED DRIVING DEVICE AND METHOD FOR DRIVING

CROSS REFERENCE TO RELATED APPLICATIONS

This application claims priority to Republic of Korea Patent Application No. 10-2020-0026092 filed on Mar. 2, 2020, and Republic of Korea Patent Application No. 10-2021-0017540 filed on Feb. 8, 2021, each of which are hereby incorporated by reference in its entirety.

BACKGROUND

1. Field of Technology

The present disclosure relates to a technique for generating clocks for driving light emitting diodes (LEDs).

2. Description of the Prior Art

In an LED panel, each pixel comprises at least one light emitting diode (LED).

In an LED panel, a greyscale value of each pixel may be represented by adjusting the level of power supplied to an LED. In order to adjust the level of power supplied to an LED, a method of adjusting the level of a voltage supplied to an LED, a method of adjusting the level of a current supplied to an LED, or a method of adjusting a time during which a current is supplied to an LED within a unit time may be used.

A method of adjusting the time during which a current is supplied to an LED within a unit time may be referred to as a pulse width modulation (PWM) method. In the PWM method, an LED driving device counts pulses of a driving clock called GCLK and supplies a current to an LED of each pixel until a count value becomes equal to a greyscale value of the pixel. When the count value is equal to a predetermined value, the LED driving device resets the count value and begins counting again.

The LED driving device may receive a data clock DCLK from a control device and receive image data in accordance with the DCLK. The LED driving device may generate a GCLK using the DCLK.

A conventional LED driving device comprises a phase detector (PD) and a multi-stage delay chain in which a delay time is adjusted by an up-down signal generated by the phase detector in order to generate a GCLK using a DCLK. However, since a plurality of delay cells are driven according to an up-down signal in such a configuration, power consumption is great.

SUMMARY

The present disclosure is to provide a technique for reducing power consumption of circuits which generate clocks for driving an LED.

To this end, in an aspect, the present disclosure provides a clock generating circuit to count a multiplied clock within a predetermined time section and to adjust a delay cell such that a count value is within a desired range, comprising the following elements and operations wherein: 1) delay cells are used; 2) a controller formed of a logic circuit generates a window signal corresponding to a predetermined time section; 3) even-numbered pulses generated by the delay cells are counted and delay times of the delay cells are adjusted so that a count value conforms to a set value; 4) when the count value conforms to the set value; 5) the controller generates another window signal; 6) odd-numbered pulses generated by the delay cells are counted and delay times of the delay cells are adjusted so that a count value conforms to the set value; and 7) the controller generates masks so that only required delay cells are selected to be driven.

In another aspect, the present disclosure provides an LED driving device to drive pixels, each comprising an LED, comprising: a data receiving circuit to receive a data clock used for reading image data; a clock generating circuit, comprising a plurality of delay cells connected in series, each to output a signal obtained by delaying an input signal, to generate a driving clock according to output signals from the plurality of delay cells; and a pixel driving circuit to drive the pixels according to the driving clock and the image data, wherein the clock generating circuit counts first pulses of a plurality of pulses generated according to the output signals from the plurality of the delay cells during a predetermined time section and adjusts delay times of the plurality of delay cells such that a count value of the first pulses conforms to a set value.

The predetermined time section may have a time length identical to one period time of the data clock.

The first pulses may be even-numbered pulses among the plurality of pulses and the clock generating circuit may generate the driving clock using odd-numbered pulses among the plurality of pulses.

Each of the plurality of delay cells may output a first output signal obtained by delaying an input signal and a second output signal obtained by reversing the first output signal, a first output signal of a delay cell previously disposed between two adjacent ones may be transferred to the subsequent delay cell as its input signal, and the clock generating circuit may AND combine the first output signal of the previous delay cell and the second output signal of the subsequent delay cell so as to generate a pulse.

The clock generating circuit may disable circuits generating the first pulses after completing the adjustment of the delay time.

The clock generating circuit may selectively drive only some circuits generating the plurality of pulses after completing the adjustment of the delay time.

The driving clock may have a frequency higher than that of the data clock.

The clock generating circuit may count the first pulses using a first window signal having a time length identical to that of the predetermined time section and the second pulses among the plurality of pulses using a second window signal having a time length identical to that of the first window signal and re-adjust delay times of the plurality of delay cells when a count value of the second pulses is greater than the set value.

The first pulses may be even-numbered pulses and the second pulses may be odd-numbered pulses among the plurality of pulses.

The clock generating circuit may generate the driving clock by OR combining the second pulses.

In still another aspect, the present disclosure provides a method of driving a pixel comprising an LED, comprising: receiving a data clock used for reading image data; generating a driving clock according to output signals from a plurality of delay cells, connected with each other in series, to output signals obtained by delaying input signals; and driving the pixel according to the driving clock and the image data, wherein in generating the driving clock, first pulses are counted among a plurality of pulses, generated according to the output signals from the plurality of delay cells, during a predetermined time section and delay times of the plurality of delay cells are adjusted such that a count value of the first pulses conforms to a set value.

In generating the driving clock of the method, the first pulses may be counted using a first window signal having a time length identical to that of the predetermined time section.

In generating the driving clock of the method, after adjusting the delay times using the first pulses, second pulses may be counted among the plurality of pulses using a second window signal having the same time length as that of the first window signal and delay times of the plurality of delay cells may be re-adjusted if a count value of the second pulses is greater than the set value.

In driving the pixel of the method, the LED comprised in the pixel may be driven in a pulse width modulation (PWM) method.

After adjusting the delay times of the plurality of delay cells, a signal representing a data clock may be transmitted to a first one of the plurality of delay cells as an input signal.

Conventionally, delay cells are continuously adjusted by a phase detector and the continuous adjustment causes a great amount of power consumption of the delay cells. On the contrary, according to the present disclosure, the delay cells are adjusted only when required, power required for the adjustment of the delay cells may be reduced.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
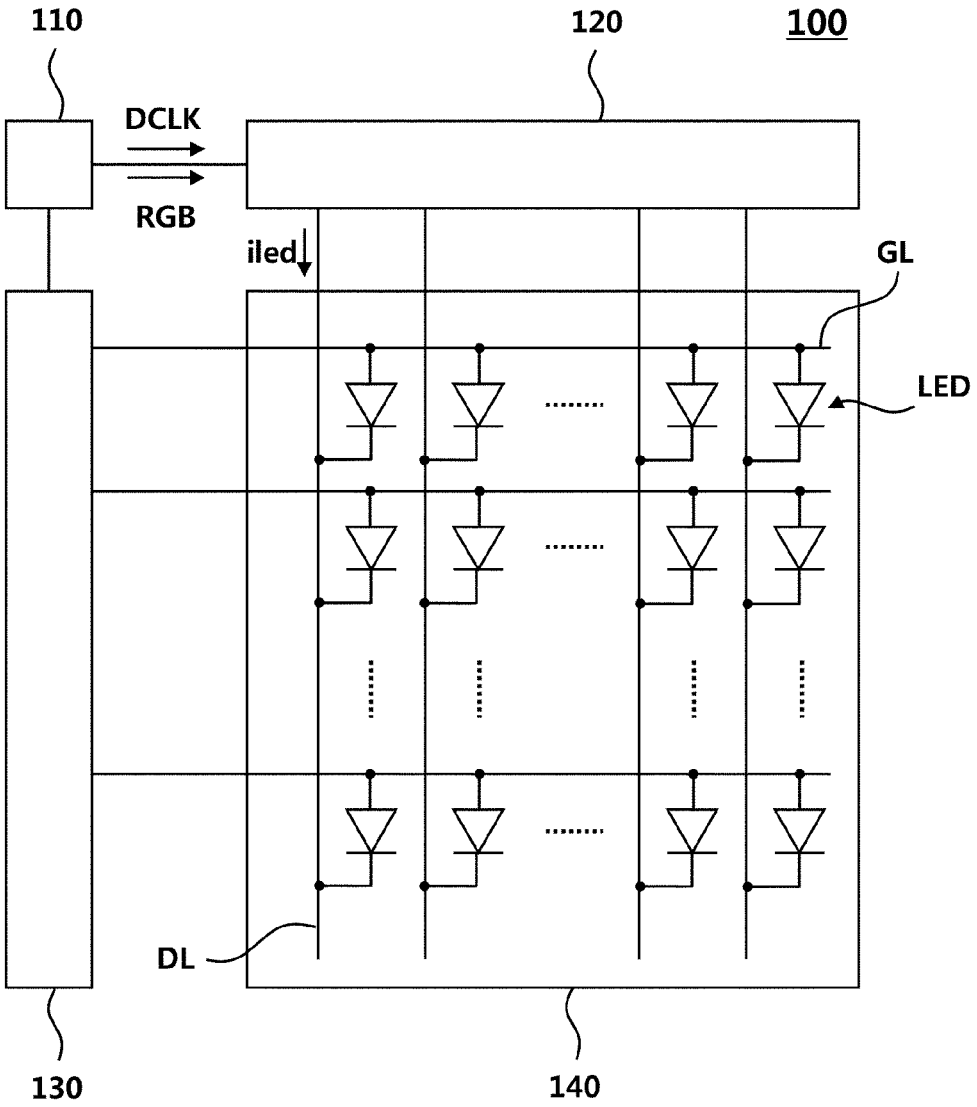
FIG. 1 is a configuration diagram of a display device according to an embodiment.

FIG. 1 is a configuration diagram of a display device according to an embodiment.

Referring to FIG. 1, a display device 100 may comprise a control device 110, a LED (light emitting diode) driving device 120, a gate driving device 130, and a LED panel 140.

On the LED panel 140, a plurality of LEDs may be disposed. Each pixel may comprise at least one LED and the LEDs may be arranged in a form of a matrix on the LED panel 140.

The LED panel 140 may comprise data lines DL extending in one direction (for example, a vertical direction in FIG. 1) and gate lines GL extending in another direction (for example, a horizontal direction in FIG. 1). An electrode (for example, a cathode electrode) of an LED may be connected to a data line DL and another electrode (for example, an anode electrode) of the LED may be connected to a gate line GL.

The gate driving device 130 may select one of a plurality of gate lines GL and connect it with a specific voltage (for example, a driving high voltage VDD or a driving low voltage VSS).

The LED driving device 120 may perform sources or sinks of a driving current iled with respect to a LED connected with a gate line GL, so that a current may flow into the LED.

The control device 110 may transmit image data RGB and a data clock DCLK to the LED driving device 120. The LED driving device 120 may receive the image data RGB in accordance with the data clock DCLK and control a driving current iled to be supplied to each pixel according to the image data RGB.

Figure 2:
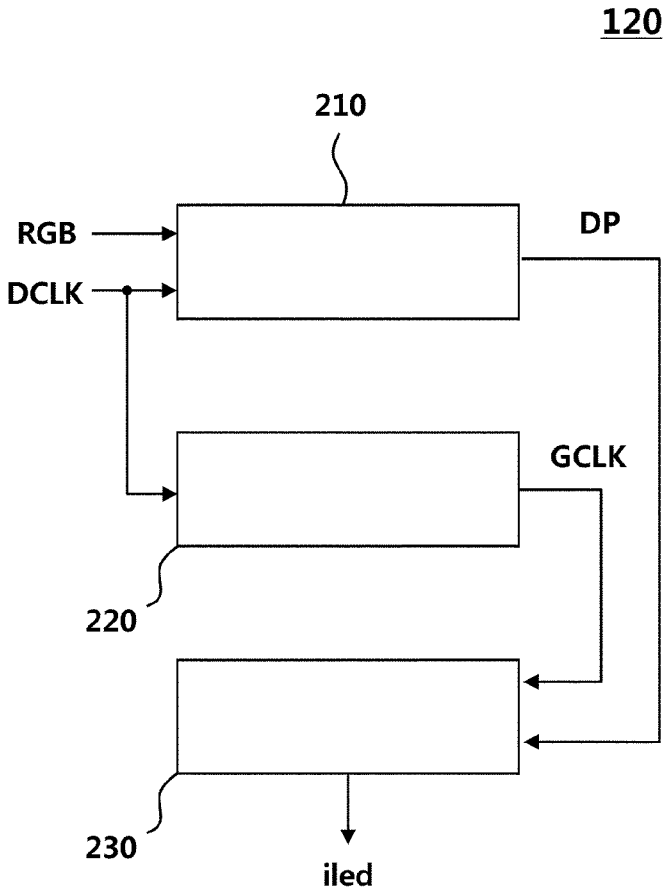
FIG. 2 is a configuration diagram of an LED driving device according to an embodiment.

FIG. 2 is a configuration diagram of a LED driving device 120 according to an embodiment.

Referring to FIG. 2, the LED driving device 120 may comprise a data receiving circuit 210, a clock generating circuit 220, and a pixel driving circuit 230.

The data receiving circuit 210 may receive image data RGB in accordance with a data clock DCLK received from the control device. Subsequently, the data receiving circuit 210 may extract from the image data RGB pixel data DP corresponding to a greyscale value of each pixel and transmit it to the pixel driving circuit 230.

The pixel driving circuit 230 may identify a greyscale value of each pixel included in the pixel data DP and adjust the level of a driving power to be supplied to each pixel according to the greyscale value. For example, the pixel driving circuit 230 may heighten the level of a driving power as the greyscale value is greater and lower the level thereof as the greyscale value is smaller.

Assuming that a forward voltage of a LED in each pixel is uniform, the level of a driving power supplied to each pixel may be determined by the level of a driving current iled supplied to each pixel. In this case, the pixel driving circuit 230 may represent a greyscale value of each pixel by adjusting the level of a driving current iled supplied to each pixel.

The pixel driving circuit 230 may adjust the level of a driving current supplied to each pixel by adjusting the duration of supplying a driving current iled within a unit time. Such a method may be referred to as a pulse width modulation (PWM) method. In the PWM method, a ratio of a duration of supplying a driving current iled to a unit time may also be referred to as a duty. The pixel driving circuit 230 may represent a greyscale value of each pixel by adjusting the duty. For example, the pixel driving circuit 230 may heighten the duty when a greyscale value is large and lower the duty when a greyscale value is small.

The pixel driving circuit 230 may implement the PWM method using clocks. For example, the pixel driving circuit 230 may count clocks, compare a count value with a value proportional to a greyscale value, and supply a driving current iled to a pixel until the count value becomes equal to the value proportional to the greyscale value. When the count value is equal to a predetermined value, the pixel driving circuit 230 may reset the count and start driving another pixel. Here, the pixel driving circuit 230 requires a clock. Such a clock may be referred to as a driving clock or a G clock GCLK.

The clock generating circuit 220 may generate a driving clock GCLK using a data clock DCLK. A period of transmitting and receiving image data and a period of driving pixels disposed on the panel need to be substantially identical or in a relation of a regular multiplication. In order to implement this, the clock generating circuit 220 may generate a driving clock GCLK associated with a pixel driving period using a data clock DCLK associated with an image data transmitting and receiving period.

Figure 3:
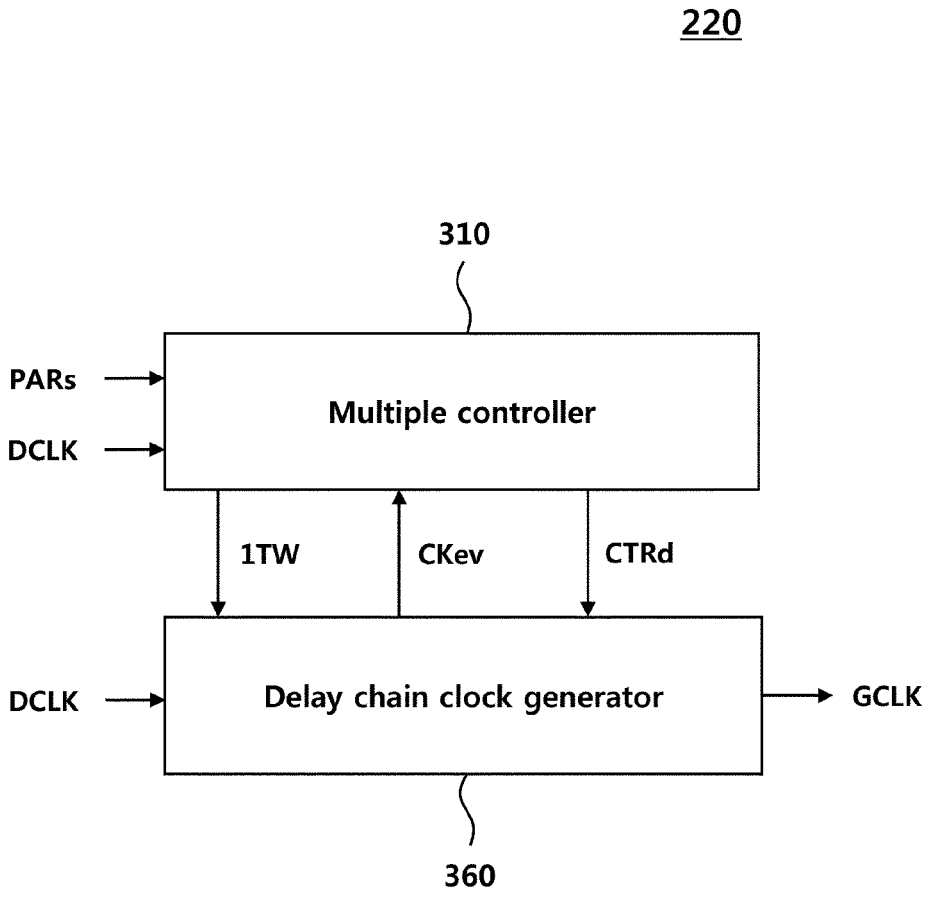
FIG. 3 is a configuration diagram of a clock generating circuit according to an embodiment.

FIG. 3 is a configuration diagram of a clock generating circuit 220 according to an embodiment.

Referring to FIG. 3, the clock generating circuit 220 may comprise a multiple controller 310 and a delay chain clock generator 360.

The multiple controller 310 may generate a window signal 1TW and transmits the window signal 1TW to the delay chain clock generator 360.

The window signal 1TW is to indicate a predetermined time section. The window signal 1TW may be maintained in a high level or a low level during the predetermined time section. The predetermined time section may have the same time length as that of one period time of a data clock DCLK. For example, the window signal 1TW may be in a high level during one period of time of the data clock DCLK and in a low level during the other times.

The delay chain clock generator 360 may comprise a plurality of delay cells, each to output a signal obtained by delaying an input signal. The plurality of delay cells may be connected with each other in series and an output signal of a previously disposed delay cell may be transferred to the subsequent delay cell as an input signal. In terms that a plurality of delay cells are connected with each other in series, the plurality of delay cells may be referred to as a delay chain.

The delay chain clock generator 360 may generate a driving clock according to output signals of the plurality of delay cells. The multiple controller 310 may transmit a delay control signal CTRd to the delay chain clock generator 360 to adjust delay times of the delay cells.

The delay chain clock generator 360 may generate a plurality of pulses according to the output signals of the plurality of delay cells. Then, the delay chain clock generator 360 may transmit to the multiple controller 310 a first clock signal CKev comprising first pulses among the plurality of pulses.

The multiple controller 310 may count the first pulses during the predetermined time section using the first lock signal CKev. Then, the multiple controller 310 may adjust delay times of the plurality of delay cells such that a count value of the first pulses conforms to a set value.

Here, the first pulses may be even-numbered pulses among the plurality of pulses. In addition, the delay chain clock generator 360 may generate a driving clock GCLK using second pulses, for example odd-numbered pulses, among the plurality of pulses.

The multiple controller 310 may receive parameters PARs associated with a multiple. The parameters PARs may be received together with image data from the control device or may be determined depending on a resistance, a voltage, a current or the like connected with pins outside the LED driving device.

The parameters PARs may comprise a multiple value and the multiple controller 310 may determine a set value according to the multiple value and adjust delay times of a plurality of delay cells such that a count value of the first pulses conforms to the set value.

Figure 4:
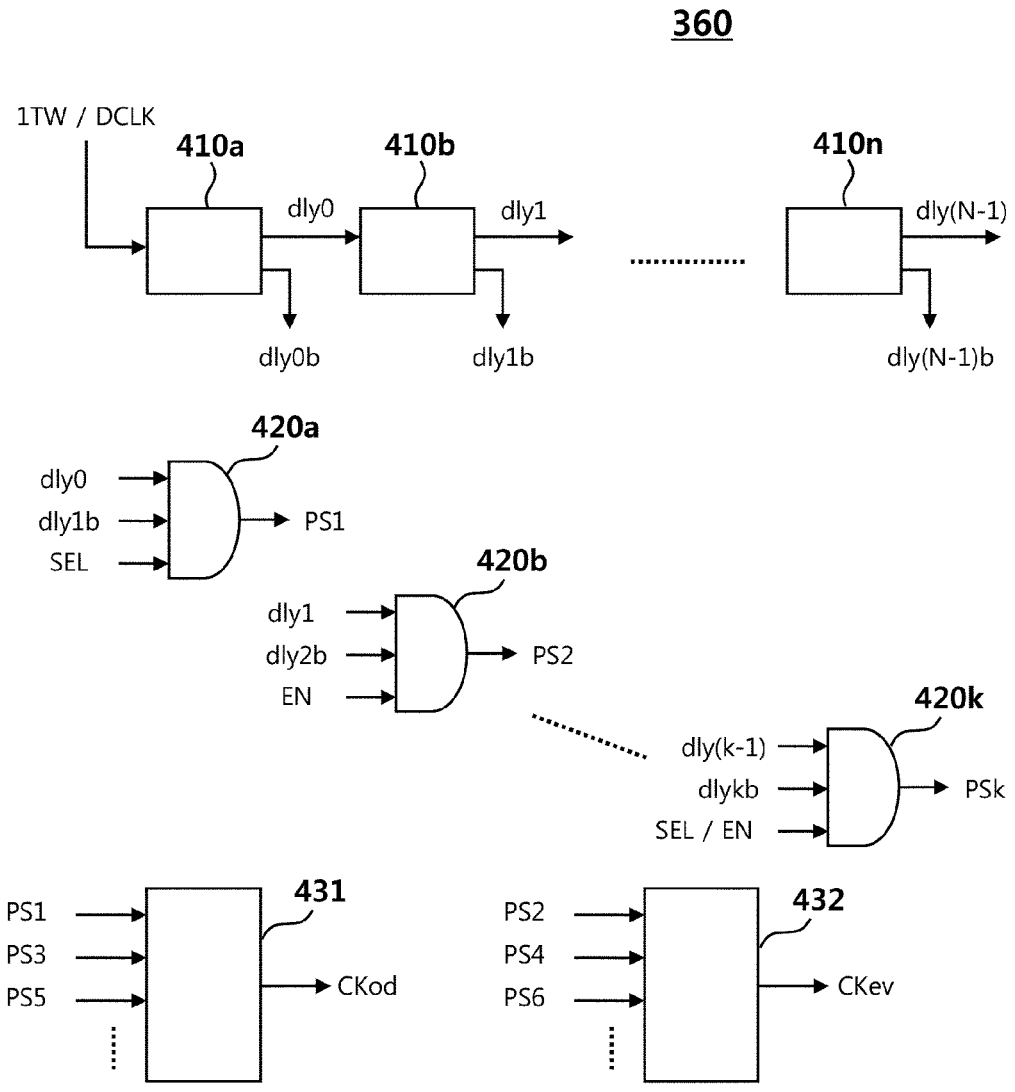
FIG. 4 is a configuration diagram of a delay chain clock generator according to an embodiment.

FIG. 4 is a configuration diagram of a delay chain clock generator 360 according to an embodiment.

Referring to FIG. 4, the delay chain clock generator 360 may comprise a plurality of delay cells 410*a*-410*n*, a plurality of AND circuits 420*a*-420*k*, a first clock signal generator 432, and a second clock signal generator 431.

The plurality of delay cells 410*a*-410*n* may be disposed in series such that an output signal of a previous delay cell is transferred to the subsequent delay cell as an input signal.

The delay cells 410*a*-410*n* may output first output signals dly0-dly(N−1) obtained by delaying input signals and second output signals dly0b-dly(N−1)b obtained by reversing the first output signals. Here, the first output signals dly0-dly(N−1) may be transferred to subsequent delay cells as input signals.

A first delay cell 410*a* among the plurality of delay cells 410*a*-410*n* may receive a window signal 1TW or a data clock DCLK as an input signal. In a case when the first delay cell 410*a* receives the window signal 1TW as an input signal, subsequent delay cells 410*b*-410*n* may receive delayed window signals as input signals.

Each of the plurality of AND circuits 420*a*-420*k* may AND combine output signals of two adjacent delay cells to generate a pulse. For example, a first AND circuit 420*a* may AND combine a first output signal dly0 of the first delay cell 420*a* and a second output signal dly1*b* of a second delay cell 410*b* to generate a first pulse PS1 and a second AND circuit 420*b* may AND combine a first output signal dly1 of the second delay cell 420*b* and a second output signal dly2*b* of a third delay cell to generate a second pulse PS2.

In this way, a Kth (K is a natural number, which is 2 or higher) AND circuit 420*k* may AND combine a first output signal dly(k−1) of a Kth delay cell and a second output signal dlykb of a K+1th delay cell to generate a Kth pulse PSk.

The first clock signal generator 432 may generate a first clock signal CKev by OR combining first pulses PS2, PS4, PS6, . . . among a plurality of pulses PS1-PSk. The second clock signal generator 431 may generate a second clock signal CKod by OR combining second pulses PS1, PS3, PS5, . . . among the plurality of pulses PS1-PSk. Here, the first pulses PS2, PS4, PS6, . . . may be even-numbered pulses and the second pulses PS1, PS3, PS5, . . . may be odd-numbered pulses among the plurality of pulses PS1-PSk.

Each component of the delay chain clock generator 360 may be determined to be driven or not by an enable signal EN or a selecting signal SEL. For example, even-numbered AND circuits 420*b*, . . . among the plurality of AND circuits 420*a*-420*k* may be driven when an enable signal EN of a high level is inputted thereto and they may be disabled when an enable signal EN of a low level is inputted thereto.

The even-numbered AND circuits 420*b*, . . . may all together be driven or disabled by receiving the same enable signals.

The odd-numbered AND circuits 420*a*, . . . may respectively be determined to be driven or not by respectively receiving selecting signals SEL. In this way, only some of the odd-numbered AND circuits 420*a*, . . . may be selected to be driven. The number of odd-numbered AND circuits 420*a*, . . . to be driven may be determined by the multiple value included in the parameters.

Depending on the multiple value included in the parameters, the number of pulses of a driving clock to be included in one period of a data clock DCLK may vary. For example, in a case when the multiple value is 4, a driving clock requires only 4 pulses during one period of a data clock DCLK. For this, only 4 of the odd-numbered AND circuits 420*a*, . . . may be driven and the rest of them may be disabled by selecting signals SEL. In a case when the multiple value is 8, only 8 of the odd-numbered AND circuits 420*a*, . . . may be driven and the rest of them may be disabled by selecting signals SEL.

Figure 5:
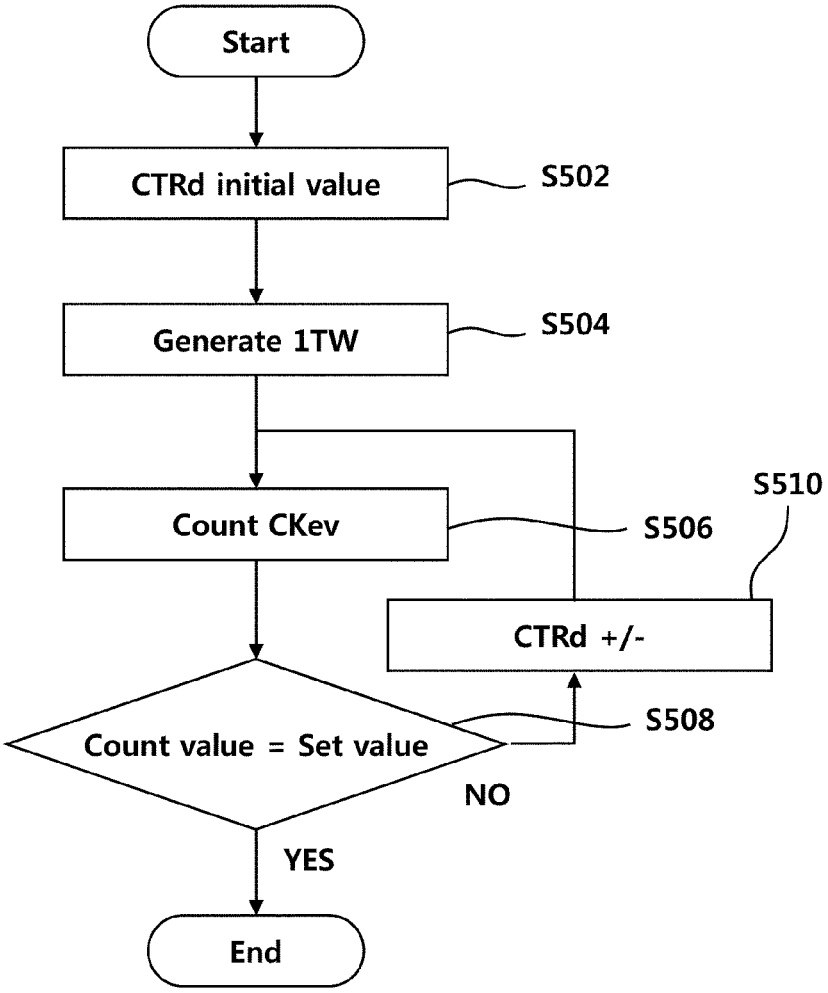
FIG. 5 is a flow diagram of a method of driving an LED according to an embodiment.
Figure 6:
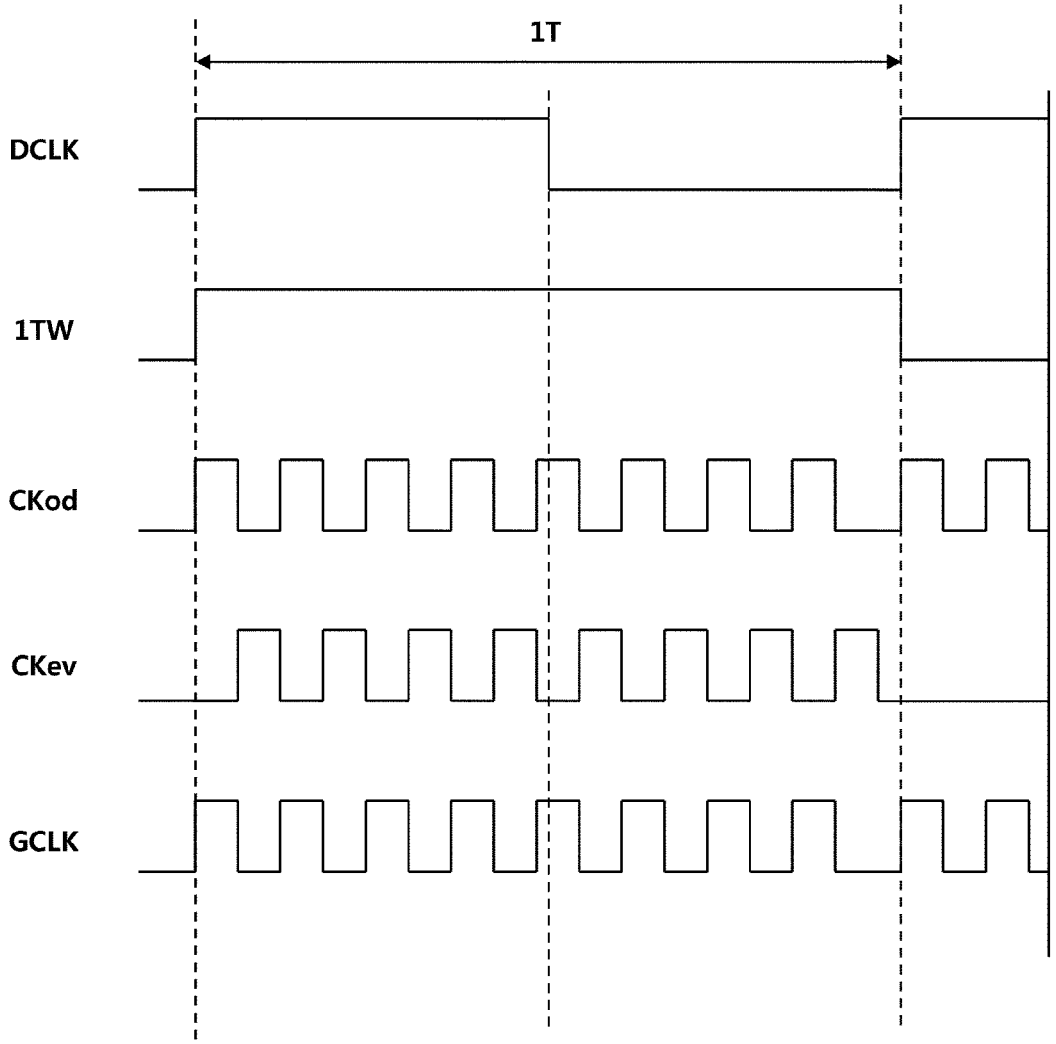
FIG. 6 is a diagram showing waveforms of main signals according to an embodiment.

FIG. 5 is a flow diagram of a method of driving an LED according to an embodiment and FIG. 6 is a diagram showing waveforms of main signals according to an embodiment.

Referring to FIG. 5 and FIG. 6, the LED driving device 120 may initialize a delay control signal CTRd (S502).

Subsequently, the LED driving device 120 may generate a window signal 1TW to indicate a predetermined time section (S504). The LED driving device 120 may receive a data clock DCLK used for reading image data and a high-level section of the window signal 1TW may correspond to one period time 1T of the data clock DCLK. The LED driving device 120 may check the one period time 1T of the data clock DCLK and generate the window signal 1TW having a high level during the same time length as that of the one period time 1T.

The LED driving device 120 may comprise a plurality of delay cells to output signals obtained by delaying input signals and to be connected with each other in series. The LED driving device 120 may count first pulses among a plurality of pulses generated according to the output signals of the plurality of delay cells during the predetermined time section indicated by the window signal 1TW (S506).

The first pulses may be combined by OR circuits to form a first clock signal CKev and the LED driving device may count the first pulses using the first clock signal CKev. The first pulses may be even-numbered pulses among the plurality of pulses. Odd-numbered pulses among the plurality of pulses may be second pulses and the second pulses may be combined by the OR circuits to form a second clock signal CKod.

The plurality of pulses may be generated to be substantially continuous. For example, a falling edge of a previously generated pulse may be synchronized with a rising edge of a subsequently generated pulse. Because of such a characteristic, the first clock signal CKev may have a form obtained by reversing the second clock signal CKod. Accordingly, counting high-level sections of the first clock signal CKev may be the same as counting low-level sections of the second clock signal CKod. In a login circuit, it may be difficult to count low-level sections. However, according to such a method of an embodiment, it would be easy to count the low-level sections of the second clock signal CKod using the first clock signal CKev.

Subsequently, the LED driving device 120 may compare a count value of the first clock signal CKev with a set value (S508) and when the count value is different from the set value (NO in S508), delay times of the plurality of delay cells may be extended or reduced by adjusting a delay control signal CTRd (S510).

After adjusting the delay times, the LED driving device 120 may use the second clock signal CKod as a driving clock GCLK.

Figure 7:
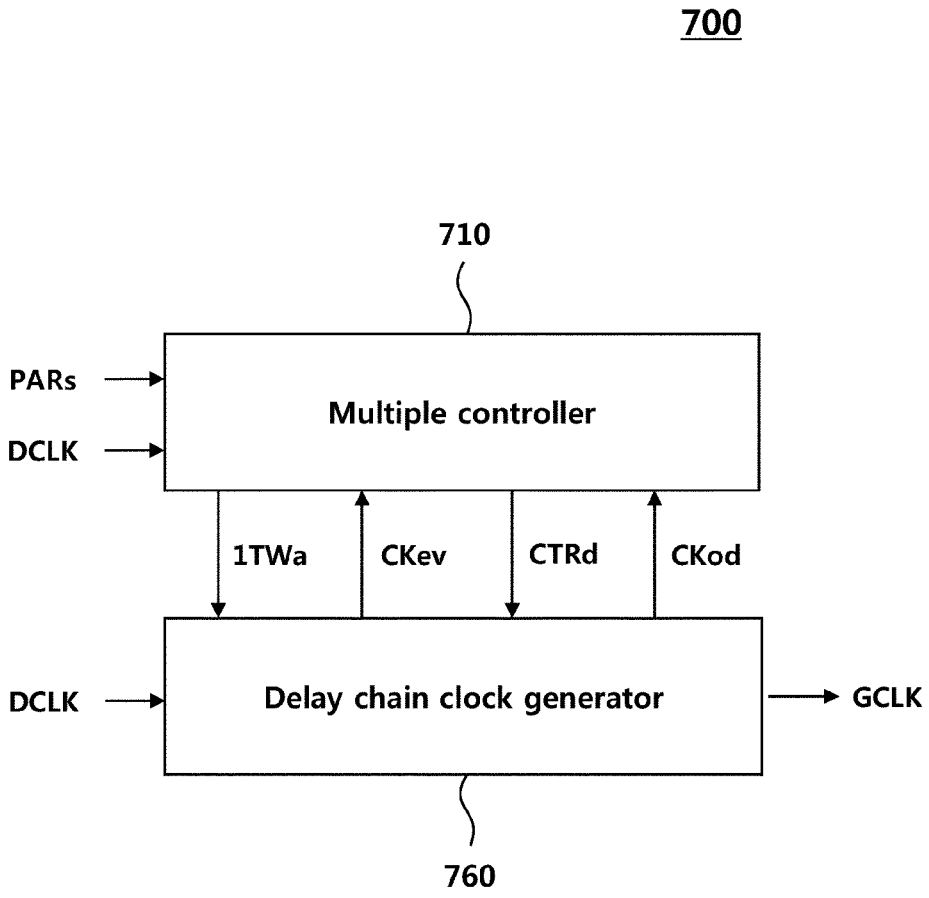
FIG. 7 is a configuration diagram of a clock generating circuit according to another embodiment.

FIG. 7 is a configuration diagram of a clock generating circuit according to another embodiment.

Referring to FIG. 7, a clock generating circuit 700 may comprise a multiple controller 710 and a delay chain clock generator 760.

The multiple controller 710 may generate a first window signal 1TWa and transmit the first window signal 1TWa to the delay chain clock generator 760.

The first window signal 1TWa, which may be to indicate a predetermined time section, may be in a high level or a low level during the predetermined time section. The predetermined time section may have the same time length as that of one period time of a data clock DCLK. For example, the first window signal 1TWa may be in a high level during one period time of a data clock DCLK and in a low level during the other times.

The delay chain clock generator 760 may comprise a plurality of delay cells to output signals obtained by delaying input signals. The plurality of delay cells may be connected in series and an output signal of a previously disposed delay cell may be transferred to the subsequent cell as an input signal. In terms that the plurality of delay cells are connected with each other in series, the plurality of delay cells may also be referred to as a delay chain.

The delay chain clock generator 760 may generate a driving clock according to output signals of the plurality of delay cells. The multiple generator 710 may transmit a delay control signal CTRd to the delay chain clock generator 760 to adjust delay times of the delay cells.

The delay chain clock generator 760 may generate a plurality of pulses according to output signals of the plurality of delay cells. Then, the delay chain clock generator 760 may transmit a first clock signal CKev formed of first pulses among the plurality of pulses to the multiple controller 710.

The multiple controller 710 may count the first pulses, during the predetermined time section indicated by the first window signal 1TW, using the first clock signal CKev. Then, the multiple controller 710 may adjust delay times of the delay cells such that a count value of the first pulses conforms to a set value.

Here, the first pulses may be even-numbered pulses among the plurality of pulses. The delay chain clock generator 760 may generate a driving clock GCLK using second pulses, for example odd-numbered pulses among the plurality of pulses.

The multiple controller 710 may receive parameters PARs associated with multiples. The parameters PARs may be received together with image data from the control device or may be determined depending on a resistance, a voltage, a current or the like connected with pins outside the LED driving device.

The parameters PARs may comprise a multiple value and the multiple controller 710 may determine a set value according to the multiple value and adjust delay times of a plurality of delay cells such that a count value of the first pulses conforms to the set value.

The multiple controller 710 may count second pulses using a second clock signal CKod formed of the second pulses, for example odd-numbered pulses, among the plurality of pulses. Here, the multiple controller 710 may generate a second window signal and count the second clock signal CKod during a time section indicated by the second window signal. Here, the time length of the time section indicated by the first window may be identical to the time length of the time section indicated by the second window signal.

In a case when a count value of the second clock signal CKod is different from the set value, the multiple controller 710 may adjust delay times of the plurality of delay cells.

For example, when the count value of the second clock signal CKod is different from the set value, the multiple controller 710 may reduce delay times of the plurality of delay cells.

Figure 8:
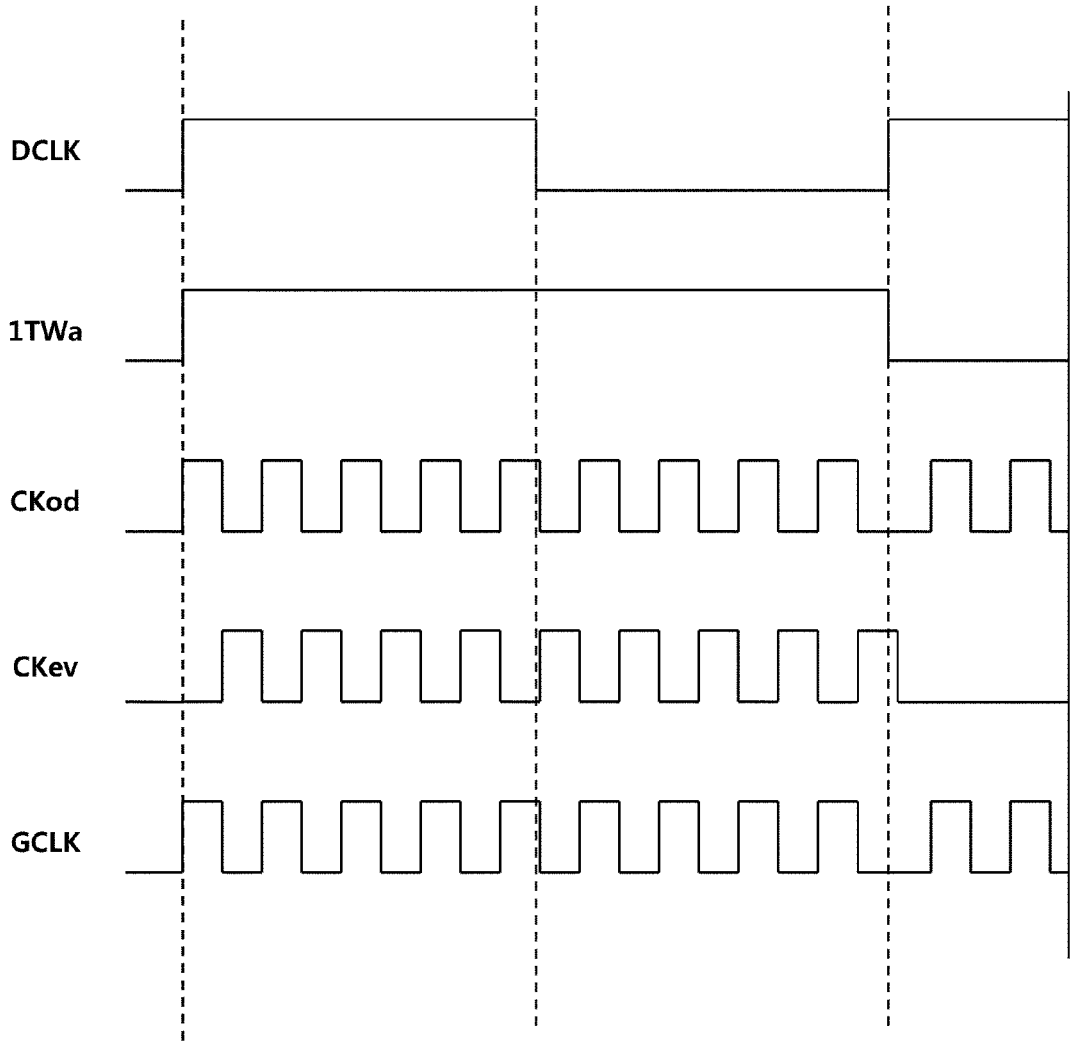
FIG. 8 is a diagram illustrating an example in which a clock generating circuit reduces delay times of delay cells according to another embodiment.

FIG. 8 is a diagram illustrating an example in which a clock generating circuit according to another embodiment reduces delay times of delay cells.

Referring to FIG. 8, the clock generating circuit may count a first clock signal CKev during a predetermined time section, for example one period time of a data clock DCLK, indicated by a first window signal 1TWa and adjust delay times of delay cells such that a count value conforms to a set value.

If the set value is 8, since the count value of the first clock signal CKev is 8 when referring to waveforms illustrated in FIG. 8, the delay times of the delay cells may be considered to be adjusted to conform to a required condition.

Here, the set value of 8 means setting the frequency of a driving clock GCLK to be 8 times the frequency of a data clock DCLK. However, according to the waveforms illustrated in FIG. 8, the frequency of a driving clock GCLK is nearly 9 times the frequency of a data clock DCLK. Such waveforms cannot be considered to conform to intended ones. The reason is that a second clock signal CKod formed of odd-numbered pulses further comprises one more pulse in the time section of the first window signal 1TWa. In order to solve such a problem, the clock generating circuit may generate a second window signal having the same time length as that of the first window signal 1TWa, count the second clock signal CKod during a predetermined time section indicated by the second window signal, and adjust delay times of the delay cells such that a count value conforms to a set value.

Figure 9:
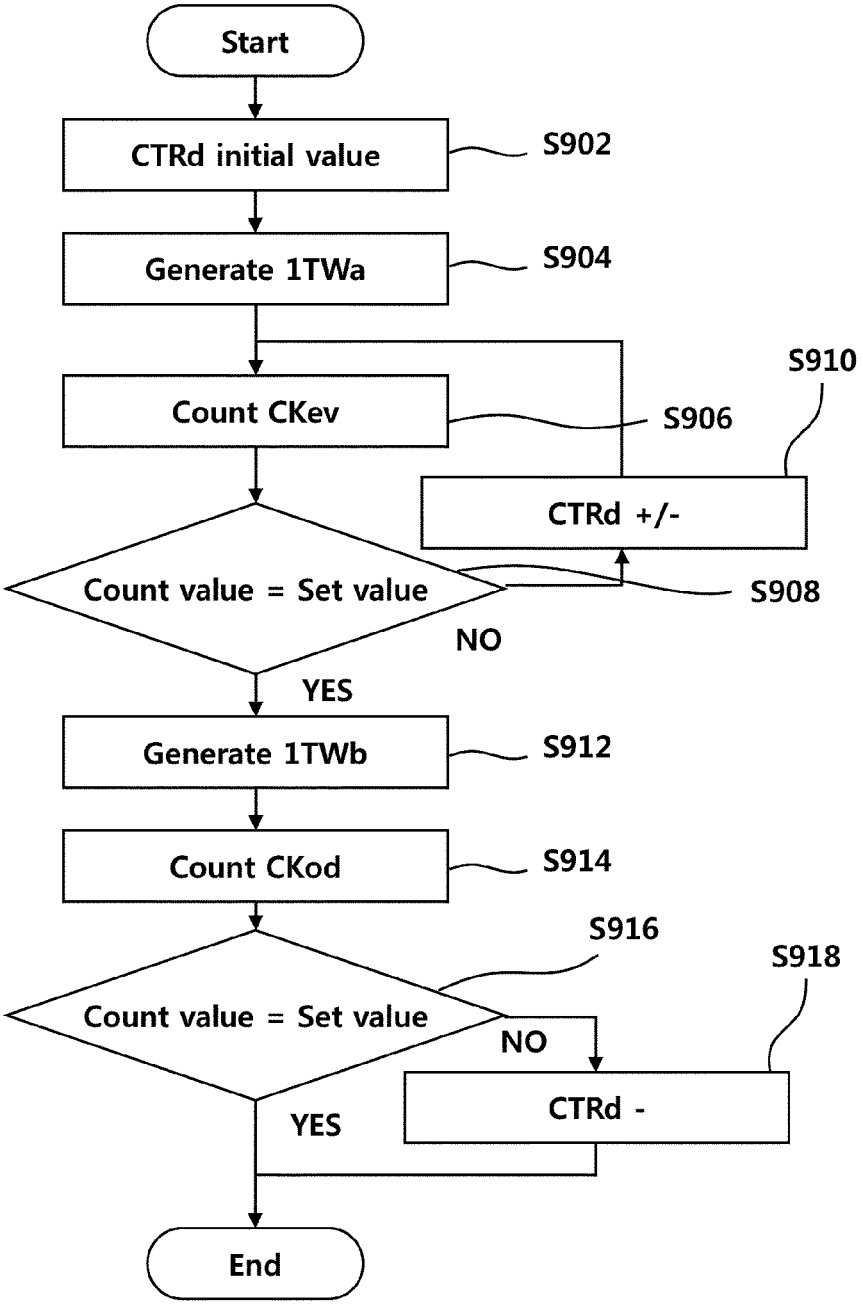
FIG. 9 is a flow diagram of a method of driving an LED according to another embodiment.

FIG. 9 is a flow diagram of a method of driving an LED according to another embodiment.

Referring to FIG. 9, the LED driving device 120 may initialize a delay control signal CTRd (S902).

Subsequently, the LED driving device 120 may generate a first window signal 1TWa indicating a predetermined time section (S904). The LED driving device 120 may receive a data clock used for reading image data and a high-level section of the first window signal 1TWa may correspond to one period time of the data clock. The LED driving device may check one period time of the data clock and generate a first window signal 1TWa having a high level during the same time length as that of the one period time of the data clock.

The LED driving device 120 may comprise a plurality of delay cells to output signals obtained by delaying input signals and to be connected with each other in series. The LED driving device may count first pulses among a plurality of pulses, generated based on output signals of the plurality of delay cells, during a predetermined time section indicated by the first window signal 1TWa (S906).

The first pulses may be combined by OR circuits to form a first clock signal CKev and the LED driving device 120 may count the first pulses through the first clock signal CKev. The first pulses may be even-numbered pulses among the plurality of pulses. Odd-numbered pulses among the plurality of pulses may form second pulses and the second pulses may be combined by the OR circuits to form a second clock signal CKod.

The plurality of pulses may be generated to be substantially continuous. For example, a falling edge of a previously generated pulse may be synchronized with a rising edge of a subsequently generated pulse. Because of such a characteristic, the first clock signal CKev may have a form obtained by reversing the second clock signal CKod. Accordingly, counting high-level sections of the first clock signal CKev may be the same as counting low-level sections of the second clock signal CKod. In a login circuit, it may be difficult to count low-level sections. However, according to such a method of an embodiment, it would be easy to count the low-level section of the second clock signal CKod using the first clock signal CKev.

Subsequently, the LED driving device 120 may compare a count value of the first clock signal CKev with a set value (S908) and when the count value is different from the set value (NO in S908), delay times of the plurality of delay cells may be extended or reduced by adjusting a delay control signal CTRd (S910).

The process from S902 to S910 may be referred to as a calibration process. After such a calibration process, the LED driving device may perform a recalibration process.

In the recalibration process, the LED driving device 120 may generate a second window signal 1TWb (S912).

The LED driving device 120 may count the second clock signal CKod during a predetermined time section indicated by the second window signal 1TWb (S914).

Subsequently, the LED driving device 120 may compare a count value of the second clock signal CKod with the set value (S916) and reduce the delay times of the delay cells using the delay control signal CTRd when the count value is different from the set value (S918).

Figure 10:
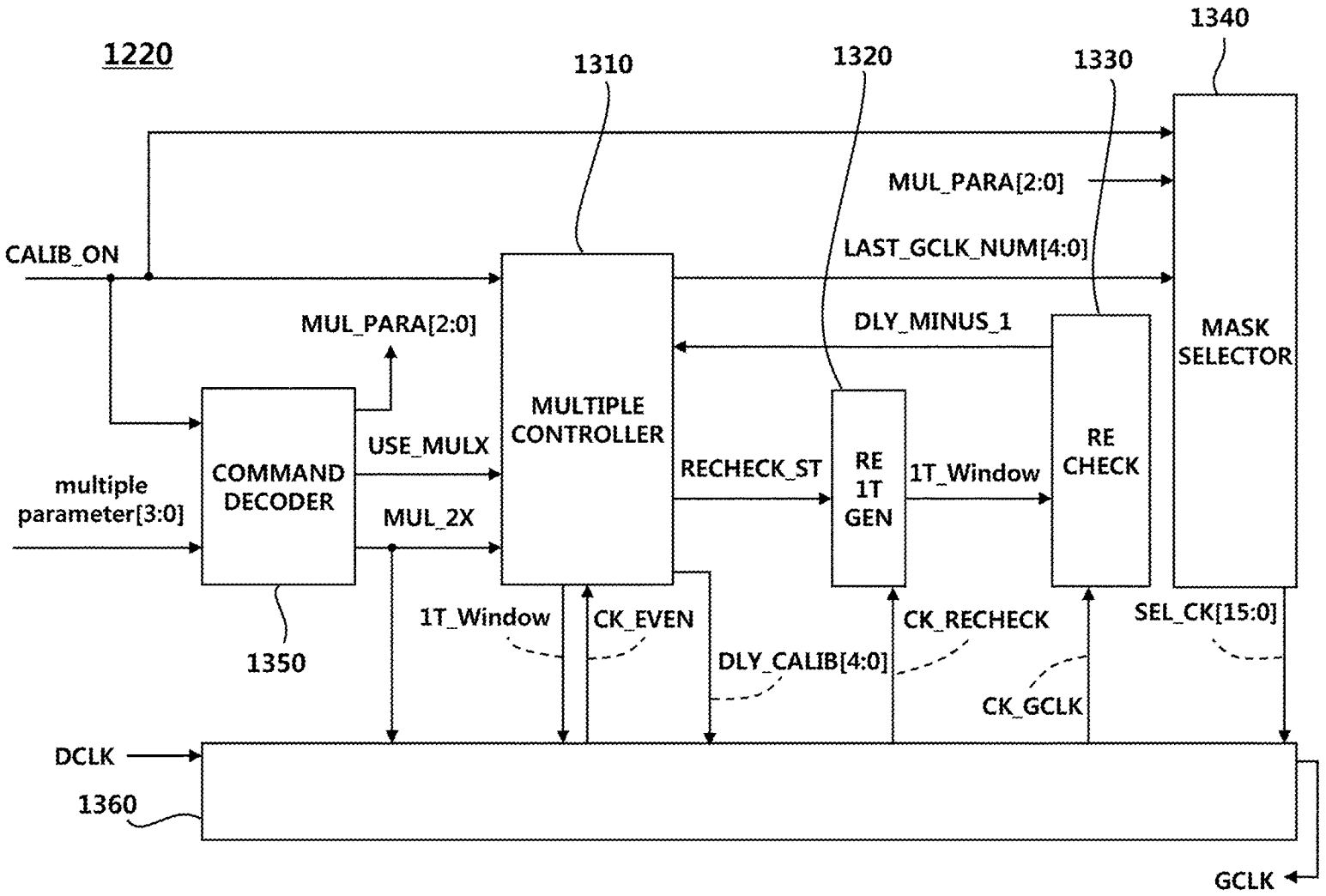
FIG. 10 is a configuration diagram of a clock generating circuit according to still another embodiment.

FIG. 10 is a configuration diagram of a clock generating circuit 1220 according to still another embodiment.

Referring to FIG. 10, a clock generating circuit 1220 may comprise a command decoder 1350, a multiple controller 1310, a 1T window signal generator 1320, a re-checker 1330, a mask selector 1340, and a delay chain clock generator 1360.

The clock generating circuit 1220 may not use a phase lock loop (PLL) circuit, but may use delay cell circuits and logic circuits to generate clocks which are N times a data clock.

The command decoder 1350 may receive a multiple parameter [3:0]. The command decoder 1350 may determine the use of the multiple controller 1310 using the multiple parameter and transmit a determined value to the multiple controller 1310 through a multiple use flag USE_MULX. If the multiple parameter is 2, the command decoder 1350 sets a flag for multiple of 2 MUL_2X so that the multiple controller 1310 may identify that the multiple parameter is 2. Subsequently, the command decoder 1350 may transmit the multiple parameter to the mask selector 1340 through a multiple parameter MUL_PARA [2:0].

The command decoder 1350 may receive a calibration-on signal CALIB_ON. The command decoder 1350 may be activated or deactivated according to the calibration-on signal CALIB_ON.

The multiple controller 1310 may be activated or deactivated according to a value of the multiple use flag USE_MULX. In addition, the multiple controller 1310 may identify by the flag for multiple of 2 MUL_2X if the multiple parameter is 2 and operate in different ways.

The multiple controller 1310 may generate a 1T window signal 1T_Window and transmit the 1T window signal 1T_Window to the delay chain clock generator 1360. Subsequently, the multiple controller 1310 may receive a result from the delay chain clock generator 1360 and adjust a delay value DLY_CALIB [4:0].

When a first calibration is completed, the 1T window signal generator 1320 may generate a 1T window signal 1T_Window in order to re-check a GCLK to be practically used.

The re-checker 1330 may re-check the GCLK to be practically used by counting the number of pulses of the GCLK during the 1T window signal generated by the 1T window signal generator 1320 and transmit a reduction signal DLY_MINUS_1 to the multiple controller 1310 such that the delay is reduced by 1 if the number of pulses is insufficient.

The mask selector 1340 may transmit to the delay chain clock generator 1360 a selection signal SEL_CK [15:0] in order to mask clocks generated by a delay chain in the delay chain clock generator 1360 using the number of pulses during the 1T window signal and the multiple parameter.

Figure 11:
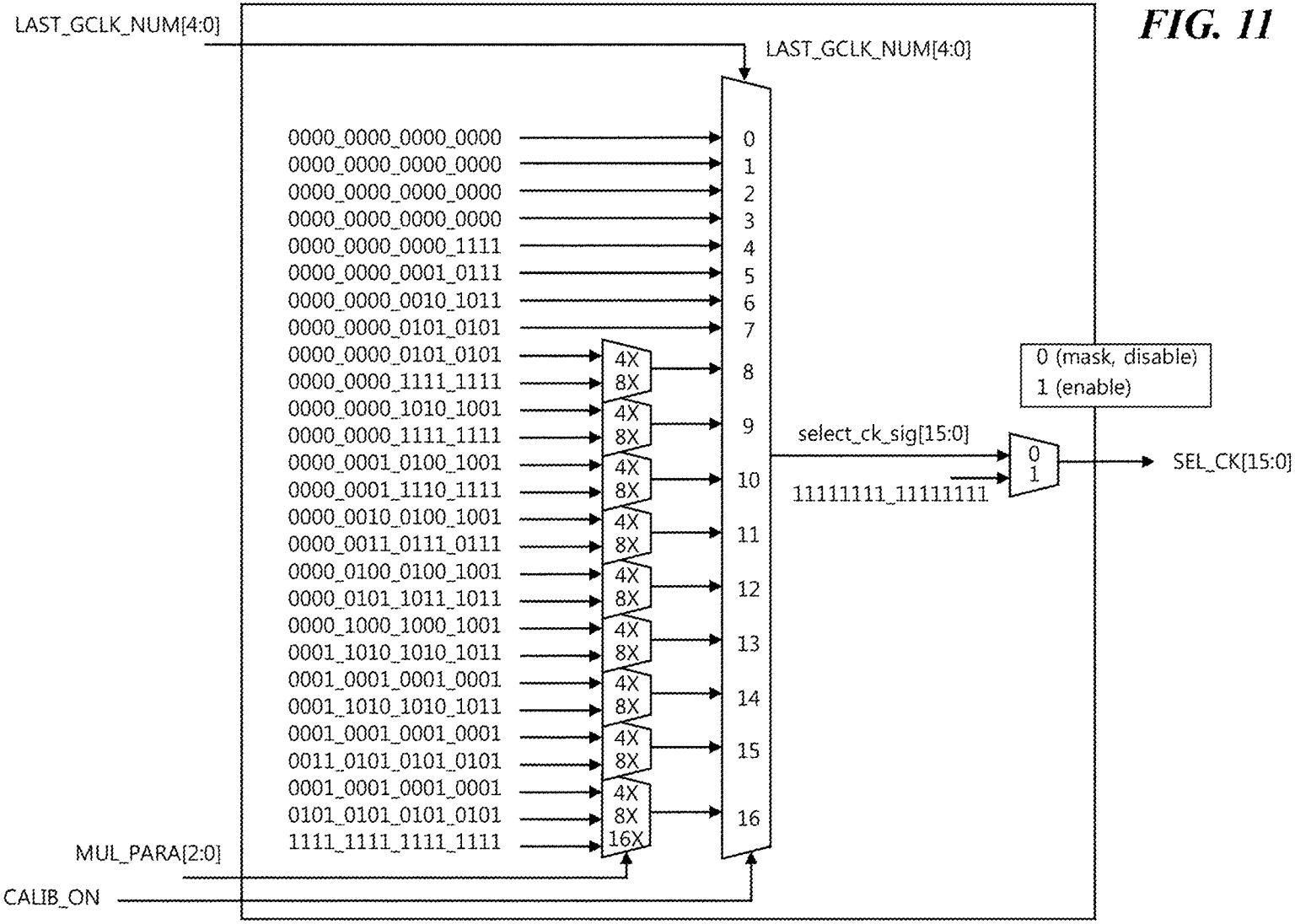
FIG. 11 is a configuration diagram of a mask selector according to still another embodiment.

FIG. 11 is a configuration diagram of a mask selector 1340 according to still another embodiment.

According to such an embodiment of the present disclosure, the delay cells may be driven only in a calibration section without using a continuous phase lock loop of a phase lock loop (PLL) or a delay lock loop (DLL).

According to such an embodiment of the present disclosure, a completely digital multiplier may be implemented by using pulses based on a 1T window.

According to such an embodiment of the present disclosure, when a calibration is completed, unused delay cells may be deactivated so that power consumption may efficiently be reduced.

According to such an embodiment of the present disclosure, a target of the multiplier is 10-30 Mhz. For this, it is possible to set a multiple as 2X, 4X, 8X, or even 16X.

According to such an embodiment of the present disclosure, any incorrect operations may be prevented by re-checking a result of the calibration using a clock to be practically used.

According to such an embodiment of the present disclosure, there would be neither a glitch nor a jitter.

What is claimed is:

1. A light emitting diode (LED) driving device to drive pixels, each pixel comprising a LED, the LED driving device comprising:

a data receiving circuit to receive image data;

a clock generating circuit, comprising a plurality of delay cells connected in series, each of the plurality of delay cells to output a signal obtained by delaying an input signal, to generate a driving clock according to output signals from the plurality of delay cells; and a pixel driving circuit to drive the pixels according to the driving clock and the image data, wherein the clock generating circuit counts a number of first pulses among a plurality of pulses, generated according to the output signals from the plurality of the delay cells, during a predetermined time section and adjusts delay times of the plurality of delay cells such that the number of the first pulses corresponds to a set value.

2. The LED driving device of claim 1, wherein the data receiving circuit receives a data clock used for reading the image data and the predetermined time section has a same time length as that of one period time of the data clock.

3. The LED driving device of claim 1, wherein the first pulses are even-numbered pulses among the plurality of pulses and the clock generating circuit generates the driving clock using odd-numbered pulses among the plurality of pulses.

4. The LED driving device of claim 1, wherein each of the plurality of delay cells outputs a first output signal obtained by delaying an input signal and a second output signal obtained by reversing the first output signal, a first output signal of a delay cell previously disposed between two adjacent ones is transferred to a subsequent delay cell as its input signal, and the clock generating circuit AND combines the first output signal of the previous delay cell and the second output signal of the subsequent delay cell so as to generate a pulse.

5. The LED driving device of claim 1, wherein the clock generating circuit disables circuits generating the first pulses after completing the adjustment of the delay time.

6. The LED driving device of claim 1, wherein the clock generating circuit selectively drives only some circuits generating the plurality of pulses after completing the adjustment of the delay time.

7. The LED driving device of claim 1, wherein the data receiving circuit receives a data clock used for reading the image data and the driving clock has a frequency higher than that of the data clock.

8. The LED driving device of claim 1, wherein the clock generating circuit counts the number of the first pulses using a first window signal having a time length identical to that of the predetermined time section and a number of second pulses among the plurality of pulses using a second window signal having a time length identical to that of the first window signal and re-adjusts delay times of the plurality of delay cells when the number of the second pulses is greater than the set value.

9. The LED driving device of claim 8, wherein the first pulses are even-numbered pulses and the second pulses are odd-numbered pulses among the plurality of pulses.

10. The LED driving device of claim 8, wherein the clock generating circuit generates the driving clock by OR combining the second pulses.

11. A method of driving a pixel comprising a light emitting diode (LED), comprising:

receiving image data;

generating a driving clock according to output signals from a plurality of delay cells, connected with each other in series, to output signals obtained by delaying input signals; and driving the pixel according to the driving clock and the image data, wherein, in generating the driving clock, a number of first pulses among a plurality of pulses, generated according to the output signals from the plurality of delay cells, are counted during a predetermined time section and delay times of the plurality of delay cells are adjusted such that the number of the first pulses corresponds to a set value.

12. The method of claim 11, wherein, in generating the driving clock, the number of the first pulses is counted using a first window signal having a time length identical to that of the predetermined time section.

13. The method of claim 12, wherein, in generating the driving clock, after adjusting the delay times using the first pulses, a number of second pulses among the plurality of pulses is counted using a second window signal having a same time length as that of the first window signal and delay times of the plurality of delay cells are re-adjusted if the number of the second pulses is greater than the set value.

14. The method of claim 12, wherein, in driving the pixel, the LED comprised in the pixel is driven in a pulse width modulation (PWM) method.

15. The method of claim 12, wherein, in receiving image data, a data clock used for reading the image data is further received and, after adjusting the delay times of the plurality of delay cells, a signal representing the data clock is transmitted to a first one of the plurality of delay cells as an input signal.

* * * * *